United States Patent [19]

Crates

[11] Patent Number: 4,766,919

[45] Date of Patent: Aug. 30, 1988

[54] UMBRELLA WITH MEANS FOR CONNECTING TO LIKE UMBRELLAS AND METHOD FOR CONSTRUCTING TEMPORARY SHELTER

[75] Inventor: Thomas B. Crates, Charlotte, N.C.

[73] Assignee: Jameson Corporation, Charlotte, N.C.

[21] Appl. No.: 37,827

[22] Filed: Apr. 13, 1987

[51] Int. Cl.[4] ..... A45F 1/16

[52] U.S. Cl. ..... 135/97; 135/98; 135/16

[58] Field of Search ..... 135/97, 98, 99, 16; 52/73, 63

[56] References Cited

U.S. PATENT DOCUMENTS

| | | | |
|---|---|---|---|
| 1,158,356 | 10/1915 | Wilson | 135/97 |
| 1,449,894 | 3/1923 | Dial | 135/98 |
| 2,932,304 | 4/1960 | Voege | 135/97 |
| 3,441,037 | 4/1969 | Transean | 135/97 |
| 3,802,450 | 4/1974 | Huddle | 135/97 |
| 3,810,481 | 5/1974 | Nohmura | 135/98 |
| 4,086,931 | 5/1978 | Hall | 135/98 |
| 4,677,796 | 7/1987 | Mellott | 135/99 |

*Primary Examiner*—Henry E. Raduazo
*Attorney, Agent, or Firm*—W. Thad Adams, III

[57] ABSTRACT

An umbrella and a temporary shelter comprised of a plurality of the connected together umbrellas includes a protective sheet having at least three straight sides. An elongate pole is attached to the center of the protective sheet for spacing the sheet in a predetermined spaced-apart relation above a surface. Ribs are attached to the sheet and means are provided for opening and closing the umbrella. Connecting means cooperate with the protective sheet for connecting together a plurality of like umbrellas along adjacent sheet edges to form a relatively large temporary protective shelter.

21 Claims, 2 Drawing Sheets

UMBRELLA WITH MEANS FOR CONNECTING TO LIKE UMBRELLAS AND METHOD FOR CONSTRUCTING TEMPORARY SHELTER

TECHNICAL FIELD AND BACKGROUND OF THE INVENTION

This invention relates to an umbrella with connecting means for enabling it to be connected to like umbrellas, and a method by which a temporary shelter can be constructed of a plurality of these umbrellas. The umbrella and shelter disclosed in this application are particularly useful for utility construction and repair workers who must often work in rain, snow and hot, sunny weather without shelter. However, the invention can be used by anyone needing shelter from either inclement weather or sun and heat. The prevalent practice now on utility construction and repair crews is to use a large, but conventional, six-sided umbrella on a wooden pole for protection from the elements. These umbrellas provide barely enough shelter for a single person, yet these crews often have two or more members. Furthermore, six-sided umbrellas are difficult to use near each other because of relatively small sides. In addition, these umbrellas are almost worthless when working next to a building, since the short side nearest the building gives only a very narrow protected working area.

For these and similar uses a square umbrella is more practical. The longer sides are more adapted for fitting up close to a building and thereby more efficiently keeping rain, snow, etc. out of the work area. However, even a square umbrella must be relatively small in order to be portable and easily opened and closed by the user. Short of erecting a conventional tent over the work area, there is no practical way of providing a covering which will shelter and protect a relatively large work area while at the same time being easy to erect, take down, and adjust to varying size and space requirements.

SUMMARY OF THE INVENTION

Therefore, it is an object of the invention to provide an umbrella which can be connected together with like umbrellas to provide a tent-like shelter of a variable size and shape.

It is another object of the invention to provide an umbrella which can be used efficiently next to a building wall because of its square shape.

It is another object of the invention to provide an umbrella which can be connected together with like umbrellas while preventing or minimizing leakage between the umbrella panels.

It is yet another object of the invention to provide an umbrella which can be connected together with like umbrellas while providing drainage areas to remove water from the top of the umbrella.

These and other objects of the present invention are achieved in the preferred embodiments disclosed below by providing an umbrella usable alone as a protective shelter or together with a plurality of like umbrellas to provide a larger, temporary shelter from the rain or sun. The umbrella comprises a protective sheet having at least three straight sides with an elongate pole attached to the center of the protective sheet for spacing the sheet in a predetermined spaced-apart relation above a surface and supporting the sheet in the spaced-apart position.

A plurality of ribs is attached to the sheet and opening and closing means are slidably positioned on the elongate pole and connected to the ribs for opening the umbrella into an open position wherein the protective sheet is extended substantially perpendicular to the elongate pole with the sheet being supported by the ribs, and a closed position wherein the protective sheet resides in a collapsed, folded position alongside the elongate pole. Connecting means cooperate with the protective sheet for connecting together a plurality of like umbrellas along adjacent sheet edges to form a relatively large temporary protective shelter.

According to one preferred embodiment of the invention, the protective sheet is square and the connecting means comprise male fastening members attached to one side edge of the sheet and complementary female fastening members attached to the opposite side edge of the sheet for attaching together a row of adjacently positioned like umbrellas.

According to another preferred embodiment of the invention, the protective sheet is square and the connecting means comprise male fastening members attached to two adjacent side edges of the sheet and complementary female fastening members attached to the other two adjacent side edges of the sheet for attaching together adjacently positioned like umbrellas in ranks and files to provide a tent-like temporary shelter.

According to one preferred embodiment of the invention, the male fastening members comprise a plurality of spaced-apart male snaps and the female fastening members comprise female snaps.

According to another preferred embodiment of the invention, the male fastening members comprise a patch or strip containing a multitude of small, outwardly extending hooks, and the female fastening members comprise a patch of strip containing loose, nonwoven fiber loops.

Preferably, the invention includes a flap connected to the sheet on each side thereof with the male and female fastening members positioned on the underside of respective ones of the flaps. When joined together, the flaps form a raised seam which aids in preventing leakage of rain between adjacent umbrellas.

In accordance with an embodiment of the invention, a temporary shelter is constructed of a plurality of connected-together umbrellas as described above.

The method of the invention described in this application comprises the steps of providing a plurality of umbrellas according to the application and connecting together a plurality of the umbrellas along adjacent sheet edges to form a relatively large temporary protective shelter.

BRIEF DESCRIPTION OF THE DRAWINGS

Some of the objects of the invention have been set forth above. Other objects and advantages of the invention will appear as the description of the invention proceeds when taken in conjunction with the following drawings, in which.

DESCRIPTION OF THE PREFERRED EMBODIMENT

Figure 1:
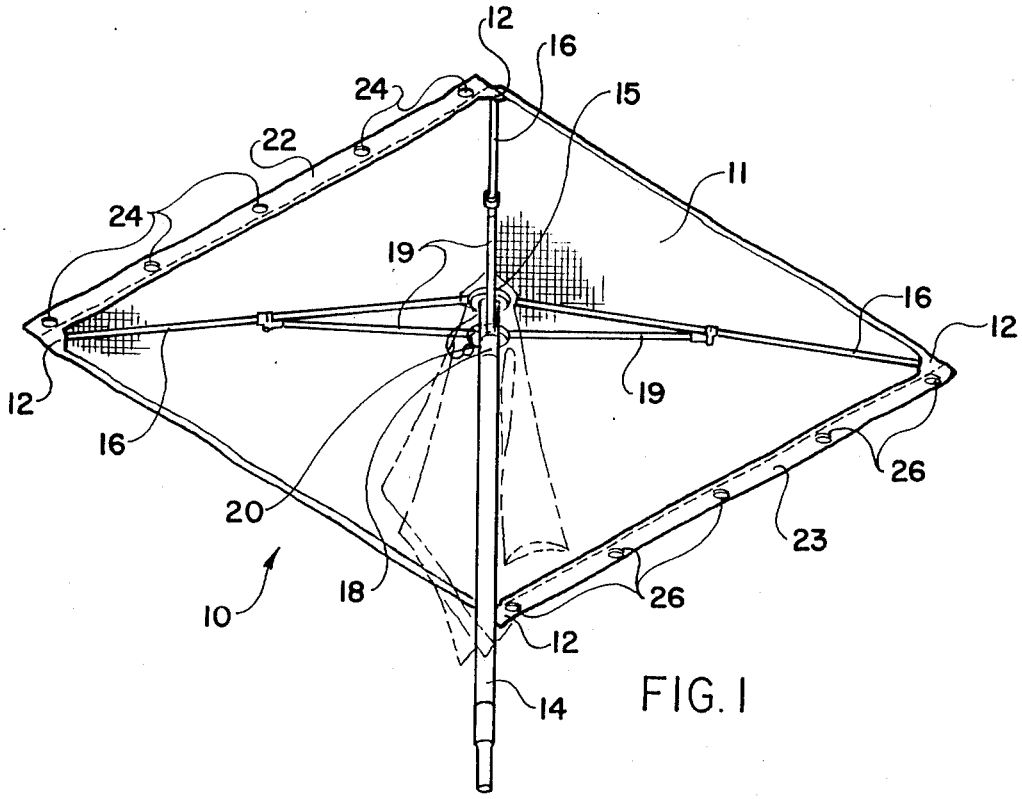
FIG. 1 is a perspective view of an umbrella according to an embodiment of the present invention, viewed from the underside.

Referring now specifically to the drawings, an umbrella according to the present invention is illustrated in FIG. 1 and shown generally at reference numeral 10. The umbrella 10 comprises a sheet 11 of waterproof material which also is sufficiently thick to block a significant amount of light and thereby provide a substantial amount of shade. A plastic coated fabric, such as canvas, is suitable. The corners of the sheet 11 are folded into small triangular pockets 12 each having a pocket opening facing towards the center of sheet 11. An elongate pole 14, preferably of fiberglass or some other non-electrically conductive material, is attached to the center of sheet 11. One end of pole 14 is positioned in a hole (not shown) in sheet 11 and secured to sheet 11 by a flange 15 (shown generally) mounted to the top of pole 14. The other end of pole 14 has a segment of reduced diameter for being received in a tubular anchor.

Four ribs 16 are carried by flange 15 and extend outwardly at right angles to the four respective corners of sheet 11. The outer end of the ribs 16 are received in the pockets 12. The ribs 16 are also constructed of fiberglass and are slightly longer than the length of the sheet 11 from the flange 15 to each pocket 12, thereby bowing the ribs 16 slightly and tensioning the sheet 11.

A collar 18 is slidably mounted on pole 14 and carries four struts 19 which are connected by their outer, free ends to a respective rib 16 intermediate its ends. Upward movement of the collar 18 along pole 14 causes the ribs 16 to move into perpendicular relation to pole 14. A pin 20 is then positioned in matingly aligned holes in collar 18 and pole 14 and the umbrella is locked in an open position. The umbrella 10 is closed by removing pin 20 and sliding collar 18 downwardly along pole 14 away from sheet 11. When closed, umbrella 10 achieves a shape shown generally in phantom lines in FIG. 1.

Means for connecting two or more of the umbrellas 10 together is also shown in FIG. 1. The particular embodiment shown comprise flaps 22 and 23 sewn onto opposite ends of sheet 11. Flap 22 has a plurality of spaced-apart male snaps 24 attached by grommets to its underside. Flap 23 has a like plurality of female snaps 26 attached by grommets to its underside.

Figure 2:
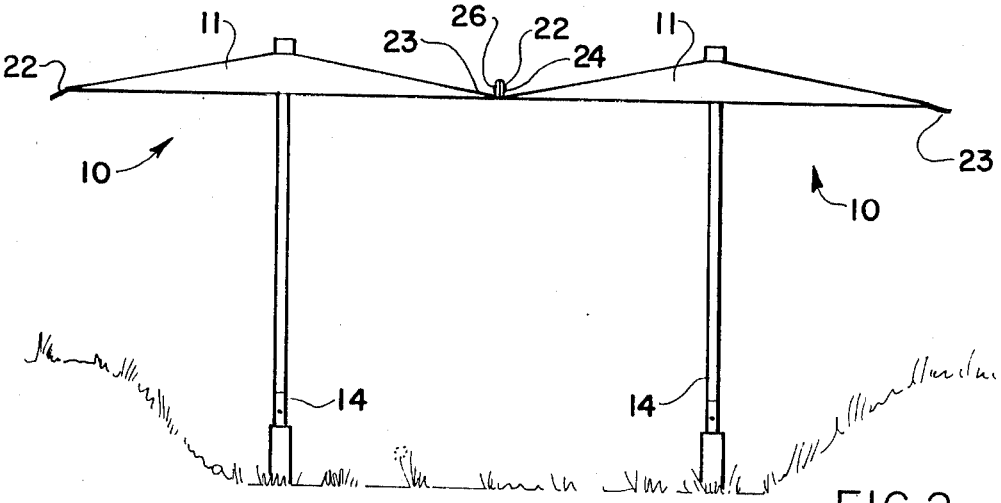
FIG. 2 is a side elevation view of two umbrellas connected together in a below-grade utility repair site.
Figure 3:
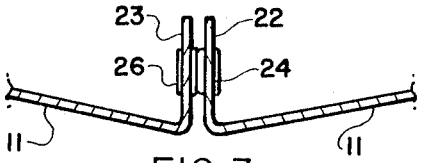
FIG. 3 is a fragmentary cross-sectional view of one manner of connecting together adjacent edges of two umbrellas by the use of snaps.

Two umbrellas 10 can therefore be connected together to form a temporary shelter in the manner shown in FIG. 2 by positioning the poles 14 of the two umbrellas 10 into anchors at the appropriate distance apart. The umbrellas are opened as described above. Then flaps 22 and 23 are turned up to position snaps 24 and 26 next to each other. By fastening together the snaps 24 and 26 the flaps 22 and 23 are held in the turned up position, as is also shown in FIGS. 2 and 3. Rain is prevented from leaking through to the area below because the actual opening is an inch or more above the surface level of sheet 11. Only a very slight amount of rain can be expected to fall directly into the open area best shown in FIG. 3. This can be eliminated by provision of a flap (not shown) which can be stitched to the top of sheet 11 adjacent the edges and draped over flaps 22 and 23 after they are connected together. Furthermore, the areas directly adjacent flaps 22 and 23 form depressions which carry water to the edges of the umbrellas where it can run off.

Figure 4:
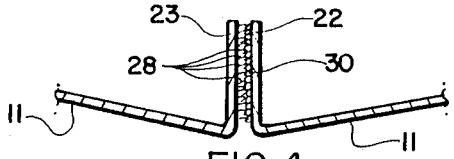
FIG. 4 is a fragmentary cross-sectional view of another manner of connecting together adjacent edges of two umbrellas by the use of hook and loop fasteners.

Another means of fastening together the flaps of adjacent umbrellas is shown in FIG. 4. A strip having male hook-like members 28 thereon is fastened to the underside of flap 23 and a strip having complementary female loops 30 is fastened to the underside of flap 22. The strips preferably extend continuously along flaps 22,23 and thereby prevent even the entry of slight amounts of water. However, spaced-apart patches of the hook-like members 18 and loops 30 could also be used.

Figure 5:
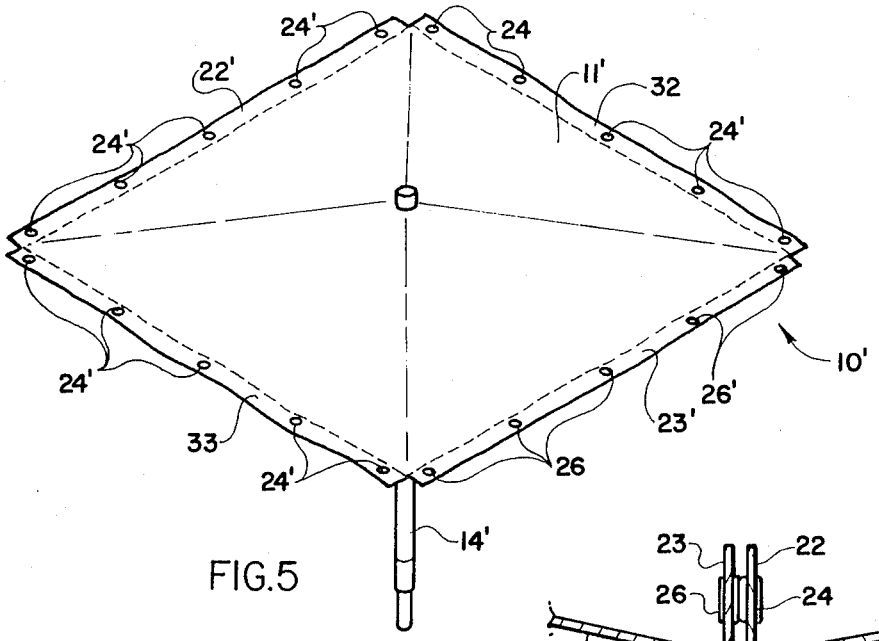
FIG. 5 is a perspective view of the top of another embodiment of the umbrella.
Figure 6:
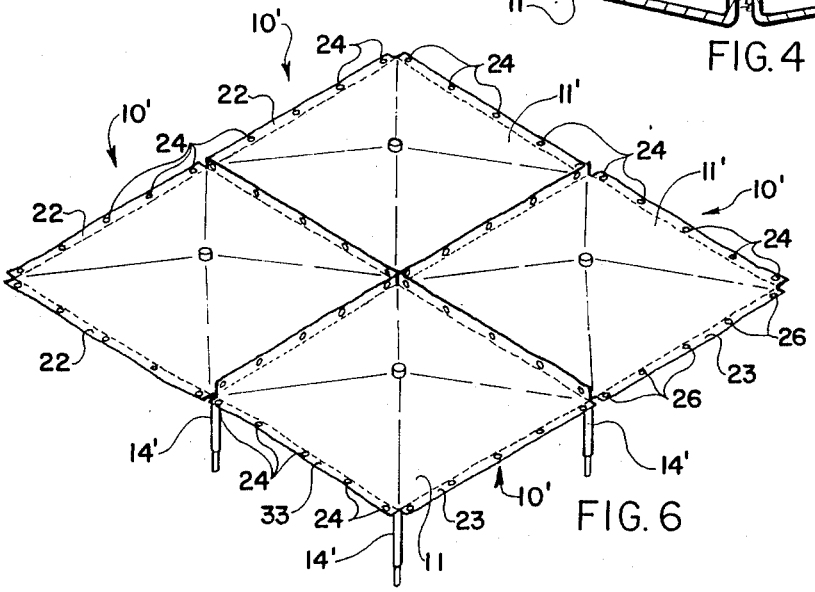
FIG. 6 is a perspective view showing four of the umbrellas connected together according to the invention.

Another embodiment of the invention is shown in FIGS. 5 and 6 and broadly designated at 10'. The basic construction of umbrella 10' is the same as umbrella 10. Hence, it will not be described in further detail and like reference numerals carrying prime notation refer to like elements of the respective embodiments. As is shown in FIG. 5, flaps 32 and 33 are attached to the sides of sheet 11' adjacent the sides having the flaps 22', 23'. Flap 32 is provided with female fasteners 26' thereon and flap 33 is likewise provided with male fasteners 24'. Any number of umbrellas 10' may therefore be connected together by fastening together adjacent flaps 22', 23' and 24', 26' respectively of the separate umbrellas 10'.

A construction as described above is shown in FIG. 6. The variety of constructions is limited only by the number of umbrellas available.

An umbrella, a temporary shelter structure and a method of constructing a temporary shelter is described above. Various details of the invention may be changed without departing from its scope. Furthermore, the foregoing description of the preferred embodiment according to the present invention is provided for the purpose of illustration only and not for the purpose of limitation--the invention being defined by the claims.

I claim:

1. An umbrella usable alone as a protective shelter or together with a plurality of like umbrellas to provide a larger, temporary shelter from the rain or sun, said umbrella comprising:

(a) a protective sheet having at least three straight sides;

(b) an elongate pole attached to the center of the protective sheet for spacing the sheet in a predetermined spaced-apart relation above a surface and supporting said sheet in the spaced-apart position;

(c) a plurality of ribs attached to said sheet;

(d) opening and closing means slidably positioned on said elongate pole and connected to said ribs for opening said umbrella into an open position wherein said protective sheet is extended substantially perpendicular to said elongate pole with the sheet being supported by the ribs, and a closed position wherein said protective sheet resides in a collapsed, folded position alongside said elongate pole; and (e) connecting means cooperating with said protective sheet for connecting together a plurality of like umbrellas along adjacent sheet edges to form a relatively large temporary protective shelter, said connecting means comprising male fastening members attached to one side edge of said sheet and complementary female fastening members attached to the opposite side edge of said sheet for attaching together a row of adjacently positioned like umbrellas.

2. An umbrella according to claim 1, wherein said protective sheet is square and wherein said connecting means comprise male fastening members attached to one side edge of said sheet and complementary female fastening members attached to the opposite side edge of said sheet for attaching together a row of adjacently positioned like umbrellas.

3. An umbrella according to claim 1, wherein said protective sheet is square and wherein said connecting means comprise male fastening members attached to two adjacent side edges of said sheet and complementary female fastening members attached to the other two adjacent side edges of said sheet for attaching together adjacently positioned like umbrellas in ranks and files to provide a tent-like temporary shelter.

4. An umbrella according to claim 2 or 3, wherein said male fastening members comprise a plurality of spaced-apart male snaps and said female fastening members comprise female snaps.

5. An umbrella according to claim 2 or 3, wherein said male fastening members comprise a patch or strip containing a multitude of small, outwardly extending hooks, and said female fastening members comprise a patch of strip containing loose, nonwoven fiber loops.

6. An umbrella according to claim 4, and including a flap connected to said sheet on each side thereof with said male and female fastening members positioned on the underside of respective ones of said flaps, which, when joined together, form a raised seam which aids in preventing leakage of rain between adjacent umbrellas.

7. An umbrella according to claim 5, and including a flap connected to said sheet on each side thereof with said male and female fastening members positioned on the underside of respective ones of said flaps, which, when joined together, form a raised seam which aids in preventing leakage of rain between adjacent umbrellas.

8. A temporary shelter comprised of a plurality of connected-together umbrellas, each of said umbrellas comprising:

(a) a protective sheet having at least three straight sides;

(b) an elongate pole attached to the center of the protective sheet for spacing the sheet in a predetermined spaced-apart relation above a surface and supporting said sheet in the spaced-apart position;

(c) a plurality of ribs attached to said sheet;

(d) opening and closing means slidably positioned on said elongate pole and connected to said ribs for opening said umbrella into an open position wherein said protective sheet is extended substantially perpendicular to said elongate pole with the sheet being supported by the ribs, and a closed position wherein said protective sheet resides in a collapsed, folded position alongside said elongate pole; and (e) connecting means cooperating with said protective sheet for connecting together a plurality of like umbrellas along adjacent sheet edges to form a relatively large temporary protective shelter, said connecting means comprise male fastening members attached to one side edge of said sheet and complementary female fastening members attached to the opposite side edge of said sheet for attaching together a row of adjacently positioned like umbrellas.

9. A temporary shelter according to claim 8, wherein said protective sheet is square and wherein said connecting means comprise male fastening members attached to one side edge of said sheet and complementary female fastening members attached to the opposite side edge of said sheet for attaching together a row of adjacently positioned like umbrellas.

10. A temporary shelter according to claim 8, wherein said protective sheet is square and wherein said connecting means comprise male fastening members attached to two adjacent side edges of said sheet and complementary female fastening members attached to the other two adjacent side edges of said sheet for attaching together adjacently positioned like umbrellas in ranks and files to provide a tent-like temporary shelter.

11. A temporary shelter according to claim 9 or 10, wherein said male fastening members comprise a plurality of spaced-apart male snaps and said female fastening members comprise female snaps.

12. A temporary shelter according to claim 9 or 10, wherein said male fastening members comprise a patch or strip containing a multitude of small, outwardly extending hooks, and said female fastening members comprise a patch of strip containing loose, nonwoven fiber loops.

13. A temporary shelter according to claim 11, and including a flap connected to said sheet on each side thereof with said male and female fastening members positioned on the underside of respective ones of said flaps, which, when joined together, form a raised seam which aids in preventing leakage of rain between adjacent umbrellas.

14. A temporary shelter according to claim 12, and including a flap connected to said sheet on each side thereof with said male and female fastening members positioned on the underside of respective ones of said flaps, which, when joined together, form a raised seam which aids in preventing leakage of rain between adjacent umbrellas.

15. A method of constructing a temporary shelter, comprising the steps of:

(1) providing a plurality of umbrellas, each of said umbrellas comprising:

(a) a protective sheet having at least three straight sides;

(b) an elongate pole attached to the center of the protective sheet for spacing the sheet in a predetermined spaced-apart relation above a surface and supporting said sheet in the spaced-apart position;

(c) a plurality of ribs attached to said sheet;

(d) opening and closing means slidably positioned on said elongate pole and connected to said ribs for opening said umbrella into an open position wherein said protective sheet is extended substantially perpendicular to said elongate pole with the sheet being supported by the ribs, and a closed position wherein said protective sheet resides in a collapsed, folded position alongside said elongate pole; and (e) connecting means cooperating with said protective sheet for connecting together a plurality of like umbrellas along adjacent sheet edges to form a relatively large temporary protective shelter, said connecting means comprise male fastening members attached to one side edge of said sheet and complementary female fastening members attached to the opposite side edge of said sheet for attaching together a row of adjacently positioned like umbrellas.

16. A method of constructing a temporary shelter according to claim 15, wherein said protective sheet is square and wherein said connecting means comprise male fastening members attached to one side edge of said sheet and complementary female fastening members attached to the opposite side edge of said sheet for attaching together a row of adjacently positioned like umbrellas.

17. A method of constructing a temporary shelter according to claim 15, wherein said protective sheet is square and wherein said connecting means comprise male fastening members attached to two adjacent side edges of said sheet and complementary female fastening members attached to the other two adjacent side edges of said sheet for attaching together adjacently positioned like umbrellas in ranks and files to provide a tent-like temporary shelter.

18. A method of constructing a temporary shelter according to claim 16 or 17, wherein said male fastening members comprise a plurality of spaced-apart male snaps and said female fastening members comprise female snaps.

19. A method of constructing a temporary shelter according to claim 16 or 17, wherein said male fastening members comprise a patch or strip containing a multitude of small, outwardly extending hooks, and said female fastening members comprise a patch of strip containing loose, nonwoven fiber loops.

20. A method of constructing a temporary shelter according to claim 18, and including a flap connected to said sheet on each side thereof with said male and female fastening members positioned on the underside of respective ones of said flaps, which, when joined together, form a raised seam which aids in preventing leakage of rain between adjacent umbrellas.

21. A method of constructing a temporary shelter according to claim 19, and including a flap connected to said sheet on each side thereof with said male and female fastening members positioned on the underside of respective ones of said flaps, which, when joined together, form a raised seam which aids in preventing leakage of rain between adjacent umbrellas.

* * * * *